US007870763B2

(12) United States Patent
Cho

(10) Patent No.: US 7,870,763 B2
(45) Date of Patent: Jan. 18, 2011

(54) STRUCTURE FOR MOUNTING TEMPERATURE SENSOR OF STEAM GENERATION APPARATUS IN DRUM TYPE WASHER

(75) Inventor: Ki Chul Cho, Masan-si (KR)

(73) Assignee: LG Electronics Inc., Seoul (KR)

( * ) Notice: Subject to any disclaimer, the term of this patent is extended or adjusted under 35 U.S.C. 154(b) by 291 days.

(21) Appl. No.: 11/660,096

(22) PCT Filed: May 18, 2006

(86) PCT No.: PCT/KR2006/001855

§ 371 (c)(1),
(2), (4) Date: Jun. 6, 2008

(87) PCT Pub. No.: WO2006/126799

PCT Pub. Date: Nov. 30, 2006

(65) Prior Publication Data

US 2008/0290234 A1 Nov. 27, 2008

(30) Foreign Application Priority Data

May 23, 2005 (KR) ..... 20-2005-0014508 U
May 23, 2005 (KR) ..... 20-2005-0014509 U
May 23, 2005 (KR) ..... 20-2005-0014510 U

(51) Int. Cl.
*D06F 33/00* (2006.01)

(52) U.S. Cl. ..... 68/12.27; 68/212; 248/27.1; 248/901

(58) Field of Classification Search ..... 248/674, 248/27.1, 56, 231.9, 901; 68/12.27, 212
See application file for complete search history.

(56) References Cited

U.S. PATENT DOCUMENTS 4,892,987 A * 1/1990 Aframian ..... 200/296
5,316,346 A * 5/1994 Maurer ..... 285/23
5,621,370 A * 4/1997 St. Louis ..... 337/380
5,624,167 A * 4/1997 Katz ..... 312/223.1
6,705,574 B2 * 3/2004 Nakagawa et al. ..... 248/49
6,732,554 B2 * 5/2004 Lamprecht et al. ..... 68/212

(Continued)

FOREIGN PATENT DOCUMENTS

CN 1534130 A 10/2004

(Continued)

*Primary Examiner*—Terrell Mckinnon
*Assistant Examiner*—Bradley H Duckworth
(74) *Attorney, Agent, or Firm*—McKenna Long & Aldridge LLP

(57) ABSTRACT

The present invention relates to a structure for mounting a temperature sensor on a steam generator, which enables easy and convenient mounting of a temperature sensor on a steam generator. For this, the present invention provides a structure for mounting a temperature sensor on a steam generator in a drum type washing machine including a case which is an exterior of the steam generator, the temperature sensor provided to the case for sensing a temperature of steam generated by a heater, a bracket for fixing the temperature sensor, a fastening portion provided to the case for fastening the bracket to the case with separate fastening members, and a bracket rotation preventive portion provided to the case for preventing the bracket from rotating at the time the temperature sensor is mounted.

24 Claims, 9 Drawing Sheets

U.S. PATENT DOCUMENTS

| | | | | |
|---|---|---|---|---|
| 2003/0213272 | A1 | 11/2003 | Lamprecht et al. | |
| 2004/0163185 | A1 * | 8/2004 | Kim et al. | 8/158 |
| 2006/0081014 | A1 * | 4/2006 | Choi et al. | 68/3 R |

FOREIGN PATENT DOCUMENTS

| | | | |
|---|---|---|---|
| GB | 1 228 315 | | 4/1971 |
| GB | 2 165 102 | | 4/1986 |
| GB | 2217110 | A | 10/1989 |
| WO | WO2006/028353 | A2 | 3/2006 |

* cited by examiner

[Fig. 1]
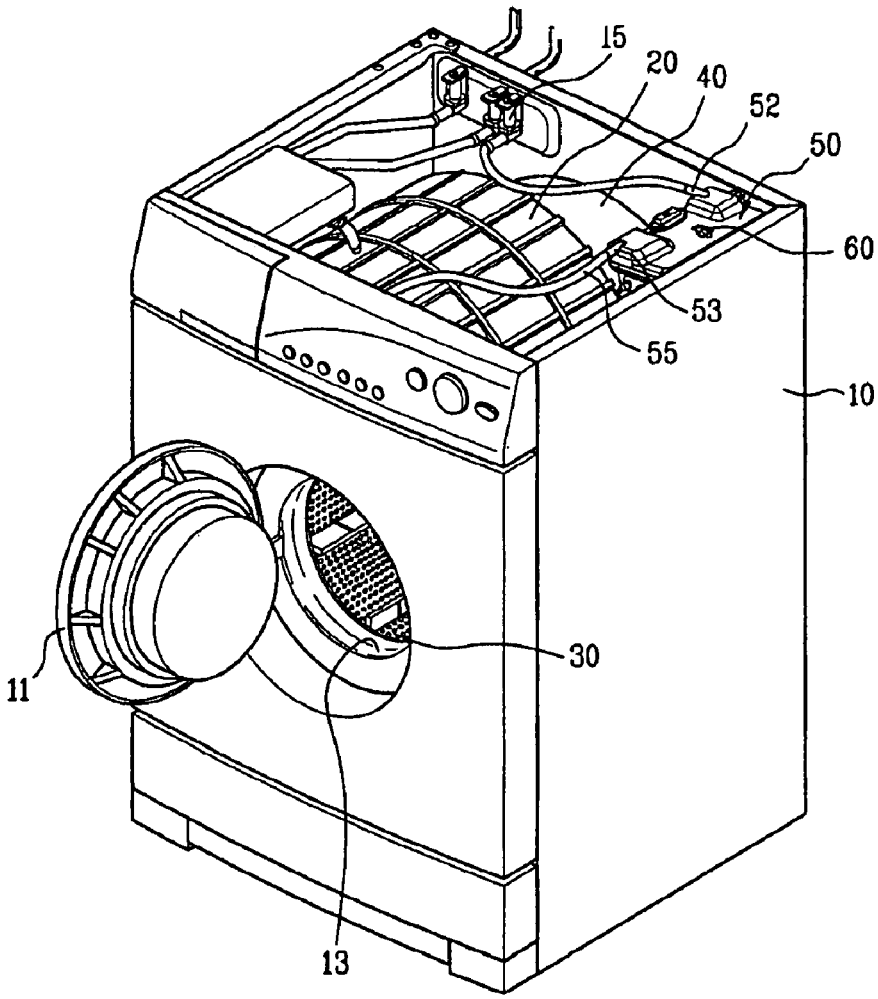

[Fig. 2]
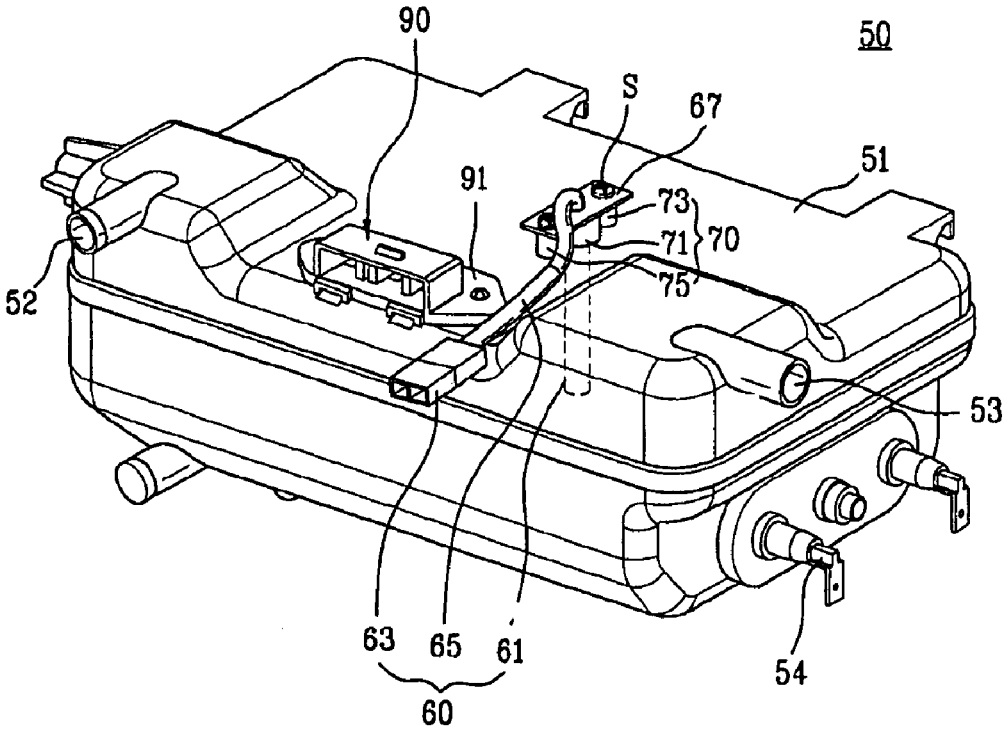
[Fig. 3]
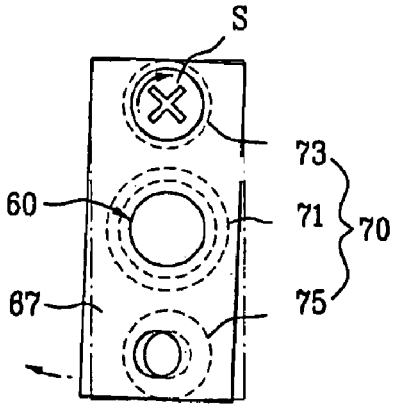

[Fig. 4]
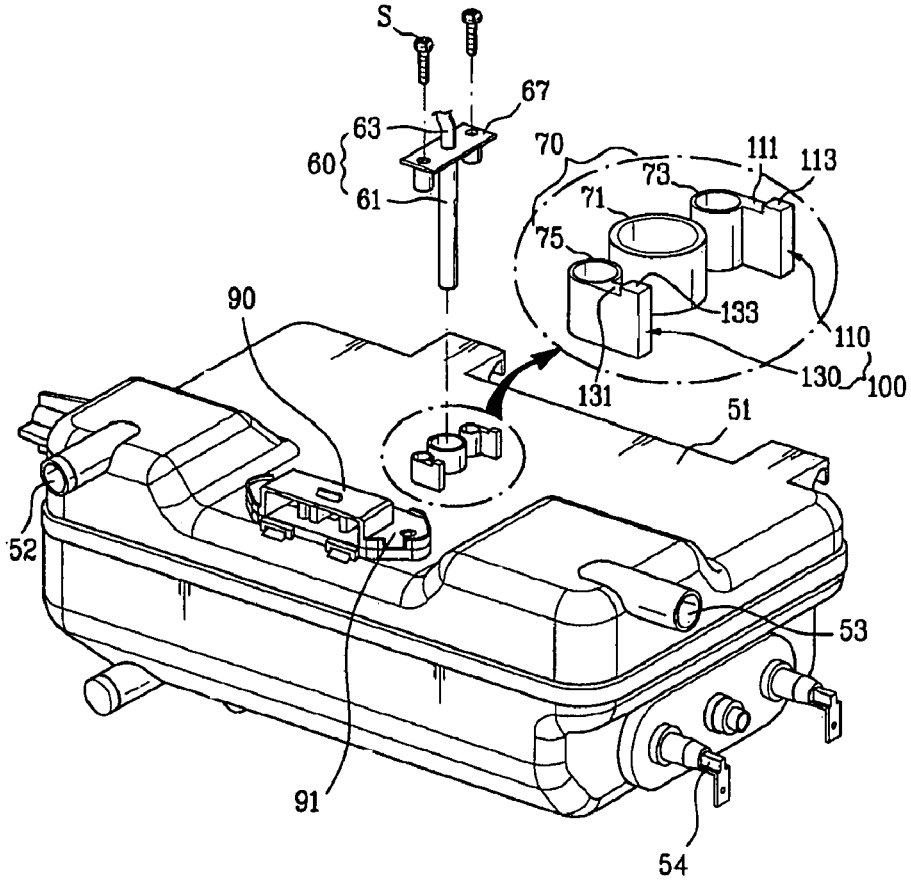
[Fig. 5]
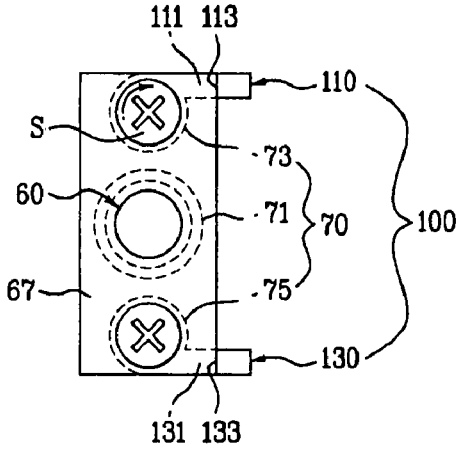

[Fig. 6]
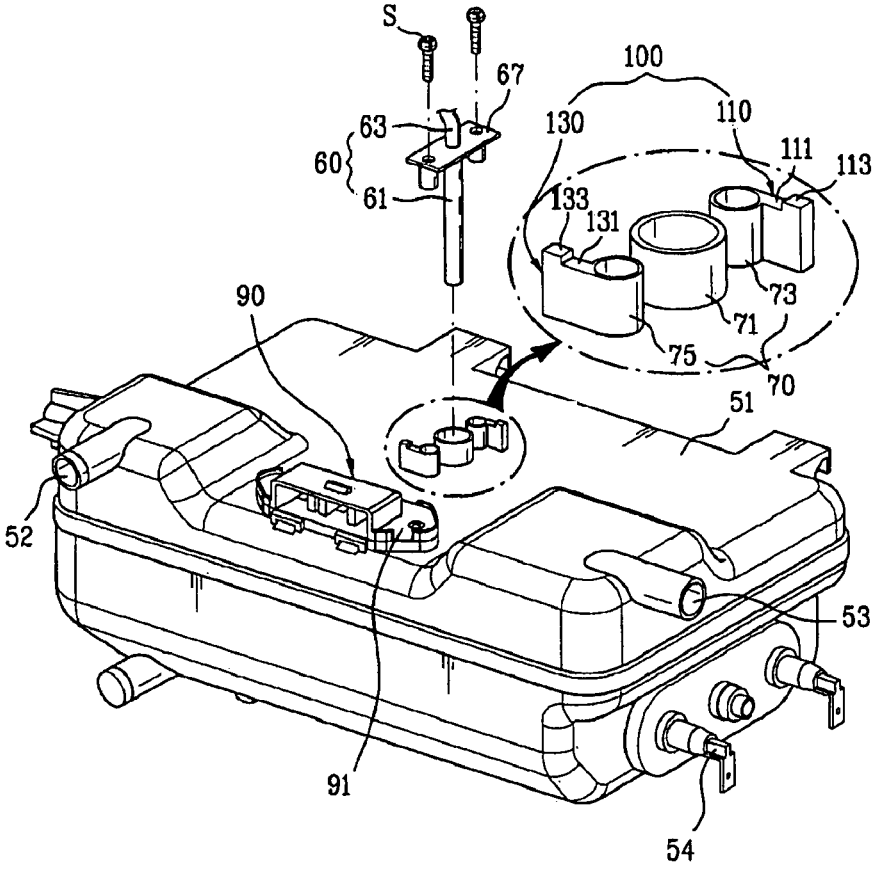
[Fig. 7]
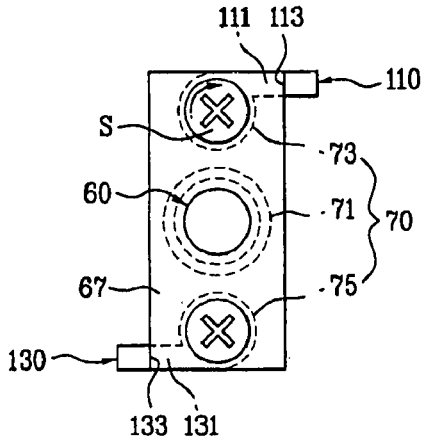

[Fig. 8]
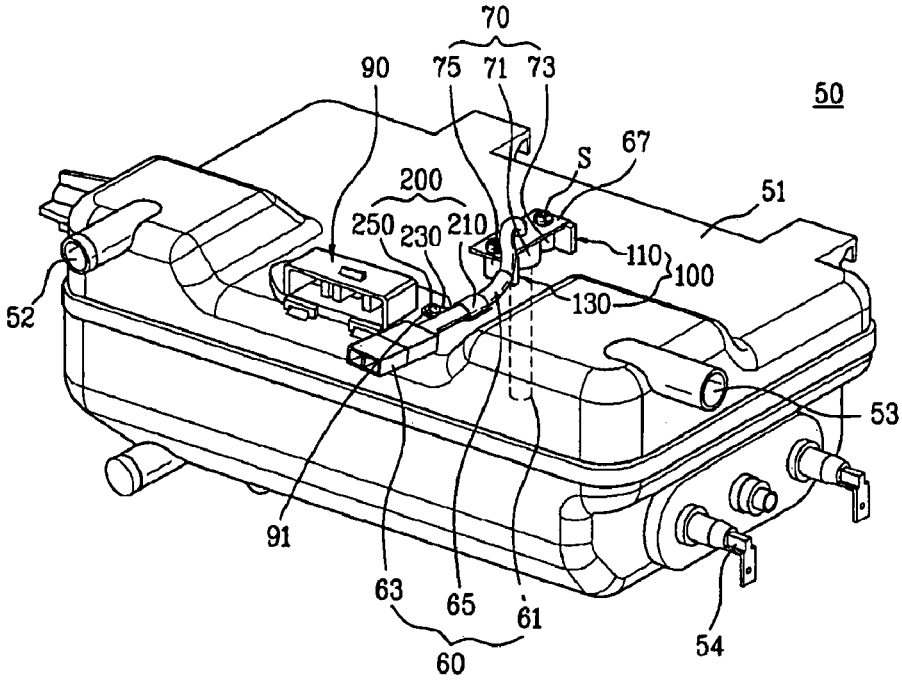
[Fig. 9]
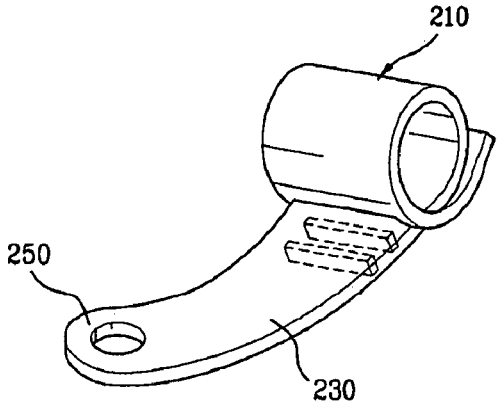

[Fig. 10]
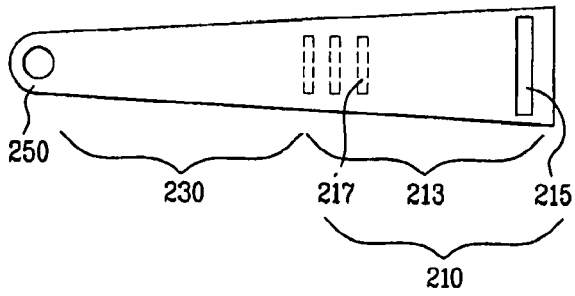
[Fig. 11]
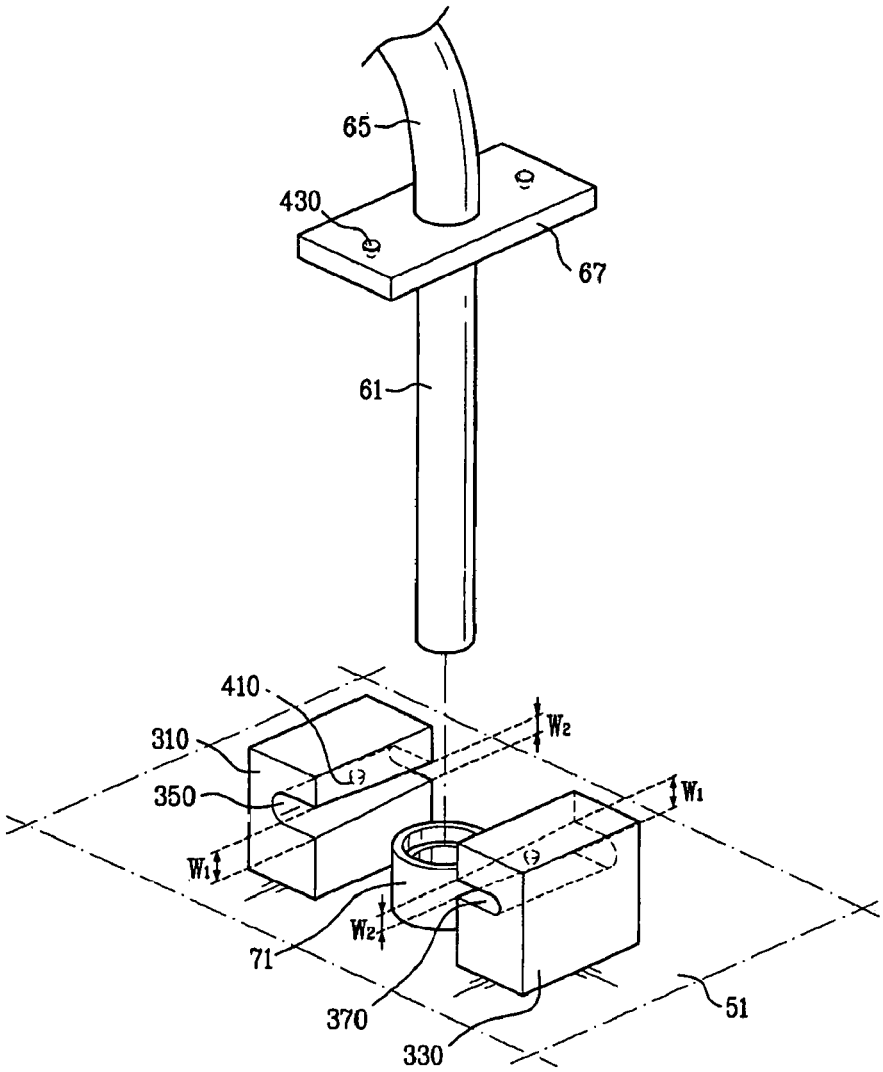

[Fig. 12]
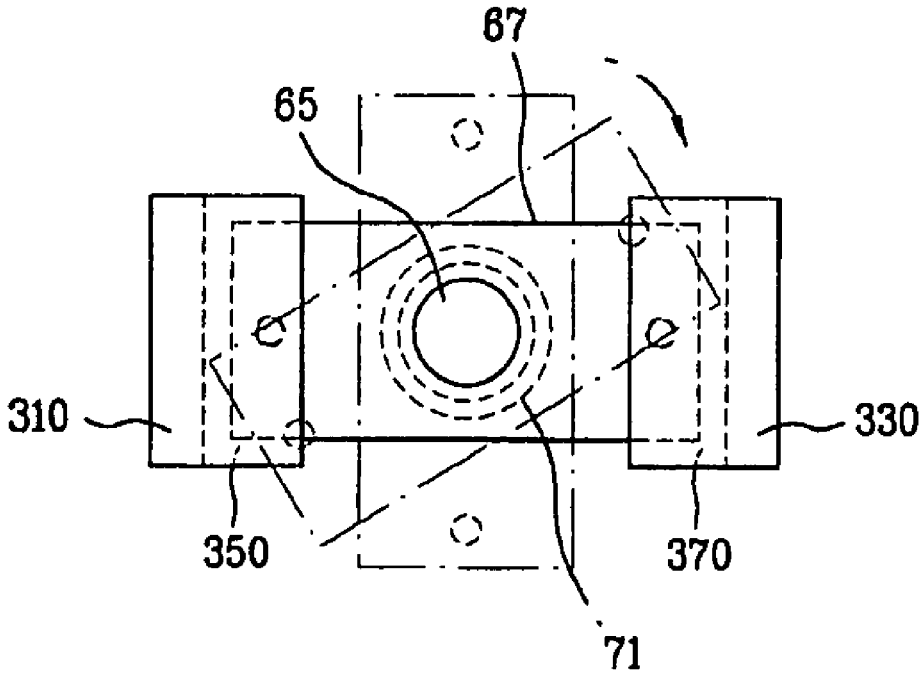
[Fig. 13]
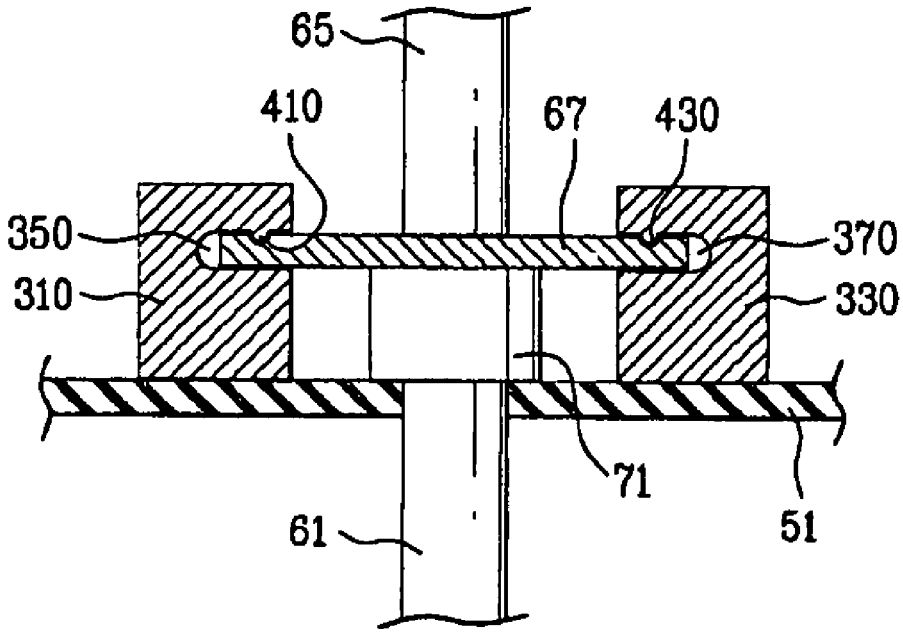

[Fig. 14]
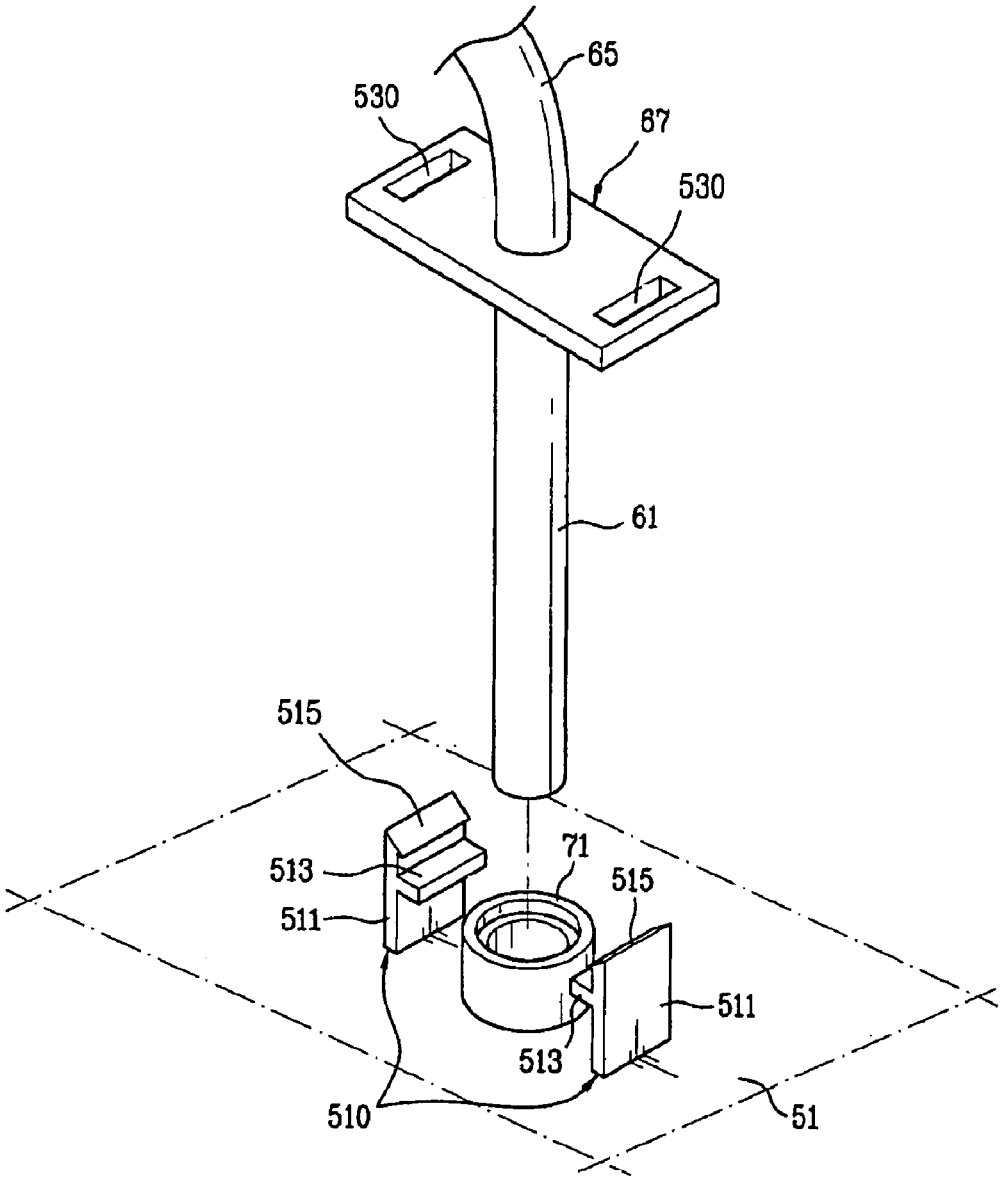

[Fig. 15]
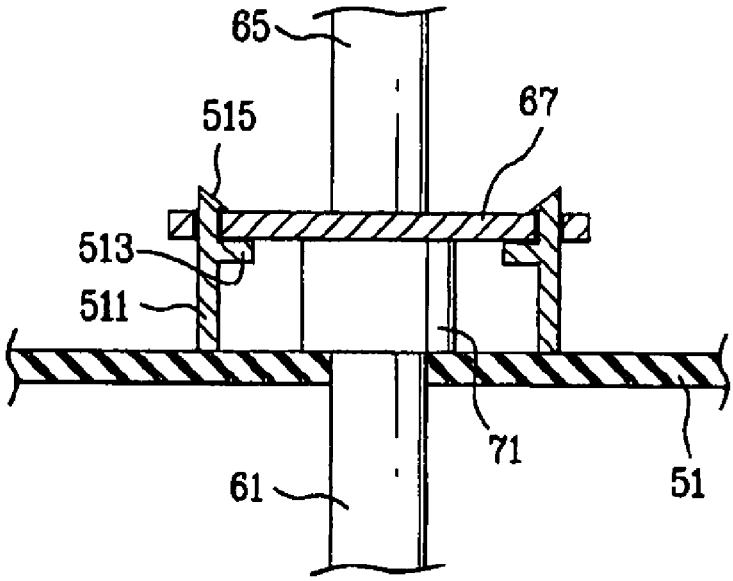

STRUCTURE FOR MOUNTING TEMPERATURE SENSOR OF STEAM GENERATION APPARATUS IN DRUM TYPE WASHER

This application claims priority to International application No. PCT/KR2006/001855 filed on May 18, 2006, Korean Application No. 20-2005-0014508 filed on May 23, 2005, Korean Application No. 20-2005-0014509 filed on May 23, 2005, Korean Application No. 10-2005-0014510 filed on May 23, 2005, all of which are incorporated by reference, as if fully set forth herein.

TECHNICAL FIELD

The present invention relates to a steam generator in a drum type washing machine, and more particularly, a structure for mounting a temperature sensor on a steam generator, which enables easy and convenient mounting of a temperature sensor on a steam generator.

BACKGROUND ART

The present invention relates to a steam generator in a drum type washing machine, and more particularly, a structure for mounting a temperature sensor on a steam generator.

In general, in washing machines, there are pulsator type washing machines in each of which washing is made with a water circulation formed by rotation of a plate shape of pulsator, and drum type washing machines in each of which washing is made by using heads of, and friction between, washing water and laundry, taken place as a laid down drum is rotated.

Of the washing machines, demands on the drum type washing machines become the greater day by day owing to advantages, such as low consumption of detergent and washing water in washing, low damage to the laundry, almost no entangling of the laundry, and so on.

A related art drum type washing machine will be described with reference to FIGS. 1 and 2.

Referring to FIG. 1, the related art drum type washing machine is provided with a cabinet 10 which is an exterior of the drum type washing machine, a cylindrical tub 20 supported horizontally in the cabinet 10 for holding washing water, a drum 30 rotatably mounted in the tub 20 having pass through holes for free flow of washing water and steam, a driving motor 40 for driving the drum 30, and at least one steam generator 50 for supplying steam to the drum 30.

The cabinet 10 has a laundry opening in a front in communication with an inside of the drum 30 for putting in and taking out laundry to/from the drum 30, with a door mounted rotatable in a front direction for opening/closing the laundry opening 13.

Along an inside circumference of the laundry opening 13, there is a gasket (not shown) for preventing hot air from leaking through joining portion between the door and the tub 30.

In the meantime, on one side of the drum type washing machine, there is a water supply valve 15 connected to an external water pipe (not shown) for supplying washing water to the tub 20 or water to the steam generator 50.

Referring to FIG. 2, a related art steam generator is provided with a case 51 which is an exterior thereof and forms a space for holding water, and a heater 54 for heating the water held therein.

The case 51 has a water inlet 52 in one side connected to the water supply valve for introduction of water to an inside thereof, and an outlet 53 in the other side connected to a steam supply pipe 55 (see FIG. 1) for supplying steam generated as the heater 54 heats water introduced into the case 51 to the drum 30 of the washing machine.

In the meantime, at a center of the case 51, there is a temperature sensor 60 for measuring a temperature of water held in the case 51.

The temperature sensor 60 is provided with a sensor portion 61 in the case 51, a connector 63 on an outside of the case 51, and a wire 65 connected between the sensor portion 61 and the connector.

The wire 63 of the temperature sensor 60 has a bracket 67 for fastening the temperature sensor 60 to an upper portion of the case 51, and the case 51 has a fastening portion 70 at an upper portion with a hole 71 for placing the sensor portion 61 in the case 51 therethrough, and a first fastening hole portion 73 and a second fastening portion 75 for fastening the bracket 67 thereto.

If the bracket 67 is fastened to the fastening portion 70 with screws S which are separate fastening members, the temperature sensor 60 is fastened to the case 51.

In the case 51, there is a water level sensor 90 for measuring a water level of the case 51, fastened to the upper portion of the case 51 with a water level sensor fastening portion 91.

However, the related art steam generator in a washing machine has the following problems.

First, referring to FIG. 3, in a case the temperature sensor 60 is fastened to the case 51 with the screws S, the bracket 67 is liable to turn along with the screw in a direction of fastening of the screw S, to require that the other side of the bracket 67 turned thus is put back to align the other side with the fastening hole portions 73, and 75, which is a cumbersome working process.

Second, the use of the screws S which are separate fastening members in a process for mounting the temperature sensor 60 to the case 51 of the steam generator 50 has a poor workability, and requires a long assembly time period.

Third, the use of the screw S in mounting the temperature sensor 60 increases unit cost of the product.

Fourth, since only the sensor portion 61 is fastened with the bracket 67 to the case 51, leaving the wire 65 and the connector 63 in contact with an outside of the case 51, heat transmitted to the wire 65 and the connector 63 through the upper portion of the case 51 from heated water in the case 51 deforms or damages the wire 65 and the connector 63.

DISCLOSURE OF INVENTION

Technical Problem

An object of the present invention is to provide a structure for mounting a temperature sensor on a steam generator in a drum type washing machine, which enables easy and convenient mounting of a temperature sensor on a case of a steam generator.

Another object of the present invention is to provide a structure for mounting a temperature sensor on a steam generator in a drum type washing machine, which enables to reduce an assembly time period by improving an assembly work of mounting a temperature sensor on a steam generator.

Another object of the present invention is to provide a structure for mounting a temperature sensor on a steam generator in a drum type washing machine, in which a structure for mounting a temperature sensor on a steam generator is improved to prevent heat from a steam generator from transmitting to a wire and a connector, directly.

Technical Solution

The objects of the present invention can be achieved by providing a structure for mounting a temperature sensor on a steam generator in a drum type washing machine including a case which is an exterior of the steam generator, the temperature sensor provided to the case for sensing a temperature of steam generated by a heater, a bracket for fixing the temperature sensor, a fastening portion provided to the case for fastening the bracket to the case with separate fastening members, and a bracket rotation preventive portion provided to the case for preventing the bracket from rotating at the time the temperature sensor is mounted.

The bracket rotation preventive portion is at least one guide rib projected from an upper surface of the case.

The bracket rotation preventive portion includes a first guide rib projected from an upper surface of the case so as to be in surface to surface contact with a side surface in the vicinity of one corner of the bracket for holding rotation of the bracket rotating together with the fastening member in a case the fastening member is being fastened in a clockwise direction, and a second guide rib projected from the upper surface of the case so as to be in surface to surface contact with the side surface in the vicinity of the other corner of the bracket for holding rotation of the bracket rotating together with the fastening member in a case the fastening member is being fastened in a counter clockwise direction.

The bracket rotation preventive portion includes a first guide rib projected from an upper surface of the case so as to be in surface to surface contact with a side surface in the vicinity of one corner of the bracket for holding rotation of the bracket rotating together with the fastening member in a case the fastening member is being fastened in a clockwise direction, and a second guide rib projected from the upper surface of the case so as to be in surface to surface contact with the other side surface opposite to the side surface in the vicinity of a diagonally opposite corner of the bracket for holding rotation of the bracket rotating together with the fastening member in a case the fastening member is being fastened in the clockwise direction.

Each of the guide ribs may include a supporting portion projected upward from the upper surface of the case for supporting an underside of the bracket, and a contact portion projected upward from one end of the supporting portion for being in contact with the side surface of the bracket.

Preferably, the bracket rotation preventive portion is formed as one body with the fastening portion.

In the meantime, the temperature sensor may include a sensor portion in the case, a connector on an outside of the case connected for supplying power to the sensor portion, and a wire connected between the sensor portion and the connector.

The structure may further include a wire holder having one end provided to the case and the other end provided to the temperature sensor and the wire for holding the temperature sensor and the wire in a state spaced from the upper portion of the case.

The wire holder may includes a holder portion provided to the wire of the temperature sensor, a supporting portion extended from the holder portion for supporting the wire of the temperature sensor in a state the wire is spaced from the upper portion of the case, and a fastening portion extended from the supporting portion for fastening the supporting portion 230.

The holder portion may include a holder forming portion for surrounding the wire, a pass through hole in the holder forming portion, and stoppers on the holder forming portion for placing in the pass through hole to prevent the holder forming portion holding the wire from being loosened.

In the meantime, the stoppers may be provided to a front surface or a back surface of the holder forming portion.

It is preferable that the fastening portion is fastened with a separate fastening member to a portion where a water level sensor is fastened.

In another aspect of the present invention, a structure for mounting a temperature sensor on a steam generator in a drum type washing machine includes a case which is an exterior of the steam generator, the temperature sensor in the case for sensing a temperature of heated water, a bracket mounted to the temperature sensor for fixing the temperature sensor to the case, and a bracket fastening portion for fastening the bracket to the upper surface of the case by pressing down opposite sides of the bracket.

The bracket fastening portion may include a first supporting block provided to an upper portion of the case for supporting one end of the bracket, and a second supporting block provided to the upper portion of the case for supporting the other end of the bracket.

The bracket fastening portion may include a first fastening slot in one side of the first supporting block for placing in and fastening one end of the bracket thereto, and a second fastening slot in the second supporting block at a portion opposite to the first supporting block for placing in and fastening the other end of the bracket thereto.

In this instance, preferably, the first fastening slot has a width which becomes the smaller as it goes from one end to the other end the more, and the second fastening slot is formed opposite to the first fastening slot.

Each of the fastening slots may have a fastening projection and the bracket may have recesses for inserting the fastening projections.

Of course, the bracket may have fastening projections formed thereon and each of the fastening slots may have a recess for inserting the fastening projections therein.

The bracket fastening portion may include at least two hooks provided to an upper surface of the case, and hook holding slots in a surface of the bracket for holding the hooks, respectively.

Each of the hooks may include a base portion projected from the upper portion of the case, a supporting portion projected from the base horizontally for supporting an underside of the bracket in a state the base is inserted in the hook holding slot, and a holder projected upward from the base for preventing the bracket supported on the supporting portion from falling off the supporting portion.

Advantageous Effects

Thus, the structure for mounting a temperature sensor on a steam generator in a drum type washing machine of the present invention has the following advantages.

First, owing to the bracket rotation preventive portion, the first preferred embodiment of the present invention prevents the bracket from rotating by fastening force of the fastening member in mounting the temperature sensor, to permit more effective and easy assembly.

Second, the second preferred embodiment of the present invention improves processability, and reduces an assembly time period and unit cost, because the bracket fastening portion is provided for mounting the temperature sensor, permitting to dispense with separate fastening members of screws.

Third, the fixing of the wire and the connector with spaces from the case by using the wire holder prevents the wire and the connector from deforming or suffering from damage caused by direct transmission of heat thereto from the case, to improve user's reliability on the product.

BRIEF DESCRIPTION OF THE DRAWINGS

The accompanying drawings, which are included to provide a further understanding of the invention, illustrate embodiment(s) of the invention and together with the description serve to explain the principle of the invention. In the drawings;

FIG. 1 illustrates a perspective view of a related art drum type washing machine, schematically;

FIG. 2 illustrates a perspective view of a steam generator in a related art drum type washing machine;

FIG. 3 illustrates a plan view showing a turning state of a bracket which is a problem of the related art;

FIG. 4 illustrates an exploded perspective view of one variation of a steam generator in accordance with a first preferred embodiment of the present invention, showing a step in which a temperature sensor is mounted on the steam generator;

FIG. 5 illustrates a diagram showing a step in which one variation of a bracket in accordance with a first preferred embodiment of the present invention is fastened, schematically;

FIG. 6 illustrates an exploded perspective view of another variation of a steam generator in accordance with a first preferred embodiment of the present invention, showing a step in which a temperature sensor is mounted on the steam generator;

FIG. 7 illustrates a diagram showing a step in which another variation of a bracket in accordance with a first preferred embodiment of the present invention is fastened, schematically;

FIG. 8 illustrates a perspective view showing a state in which a temperature sensor wire in accordance with a first preferred embodiment of the present invention is fastened with a holder;

FIG. 9 illustrates a perspective view of a wire holder in accordance with a first preferred embodiment of the present invention;

FIG. 10 illustrates a developed view of FIG. 9;

FIG. 11 illustrates a perspective view of one variation of a steam generator in accordance with a second preferred embodiment of the present invention, showing a step in which a temperature sensor is mounted on the steam generator;

FIG. 12 illustrates a diagram showing a step in which a variation of a temperature sensor in accordance with a second preferred embodiment of the present invention is mounted, schematically;

FIG. 13 illustrates a section showing a state in which a variation of a temperature sensor in accordance with a second preferred embodiment of the present invention is mounted;

FIG. 14 illustrates a perspective view of another variation of a steam generator in accordance with a second preferred embodiment of the present invention, showing a step in which a temperature sensor is mounted on the steam generator; and FIG. 15 illustrates a perspective view of another variation of a steam generator in accordance with a second preferred embodiment of the present invention, showing a step in which a temperature sensor is mounted on the steam generator.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIG. 4 illustrates an exploded perspective view of one variation of a steam generator in accordance with a first preferred embodiment of the present invention, showing a step in which a temperature sensor is mounted on the steam generator, and FIG. 5 illustrates a diagram showing a step in which one variation of a bracket in accordance with a first preferred embodiment of the present invention is fastened, schematically.

Referring to FIG. 4, the structure for mounting a temperature sensor on a steam generator in accordance with a first preferred embodiment of the present invention, including a case 51 which is an exterior of the steam generator, a temperature sensor 60 for measuring a temperature of heated water in the case 51, a rectangular bracket 67 for fastening the temperature sensor 60, and a fastening portion 70 having a first fastening hole portion 73 and a second fastening hole portion 75 provided to the case 51 for fastening the bracket 67 with a separate fastening member, wherein the structure further includes a bracket rotation preventive portion 100 provided to the case 51 for preventing the bracket 67 from turning by fastening force of the fastening member in mounting the temperature sensor 60.

The bracket rotation preventive portion 100 is at least one guide rib projected from an upper surface of the case 51. The structure for mounting a temperature sensor on a steam generator in accordance with a preferred embodiment of the present invention suggests two guide ribs.

Referring to FIG. 4, the bracket rotation preventive portion 100 in accordance with a first preferred embodiment of the present invention includes a first guide rib 110 projected from an upper surface of the case 51 so as to be in surface to surface contact with a side surface in the vicinity of one corner of the bracket 67 for holding rotation of the bracket 67 rotating together with the fastening member in a case the fastening member is being fastened in a clockwise direction, and a second guide rib 130 projected from the upper surface of the case 51 so as to be in surface to surface contact with the side surface in the vicinity of the other corner of the bracket 67 for holding rotation of the bracket 67 rotating together with the fastening member in a case the fastening member is being fastened in a counter clockwise direction.

It is preferable that the guide ribs 110, and 113 are formed as one body with the first fastening hole portion 73 and the second fastening hole portion 75, respectively.

Of course, though it is possible that the guide ribs 110, and 130 are formed and mounted on the upper portion of the case 51 separate from the first fastening hole portion 73 and the second fastening portion 75 respectively, it is preferable that the guide ribs 110, and 130 are formed as one body with the first fastening hole portion 73 and the second fastening portion 75 respectively for reducing a fabrication cost and process.

In this instance, each of the guide ribs 110 and 130 may include a supporting portion 111, or 131 for supporting an underside of the bracket 67, and a contact portion 113, or 133 projected upward from one end of the supporting portion 111, or 131 for being in contact with the side surface of the bracket 67.

A process for mounting the temperature sensor on the foregoing one variation of a steam generator in a drum type washing machine in accordance with a first preferred embodiment of the present invention will be described.

At first, the sensor portion 61 is placed in the hole 71 of the fastening portion 70 such that the sensor portion 61 is positioned in the case 51.

Then, an underside of the bracket 67 fixed to the wire 63 is placed on the supporting portions 111, and 131 of the guide ribs 110, and 130.

In this instance, the side surface in the vicinity of one corner of the bracket 67 is in contact with the contact portion 113 of the first guide rib 110, and the side surface in the vicinity of the other corner of the bracket 67 is in contact with the contact portion 133 of the second guide rib 130.

Next, after the screw 'S' is fastened to, the first fastening hole portion 73 on a side where the first guide rib 110 is mounted in a clockwise direction, to fix one end of the bracket 67, and the screw 'S' is fastened to the second fastening hole portion 75 on a side where the second guide rib 130 is mounted, to fix the other end of the bracket 67.

In this instance, referring to FIG. 5, the surface to surface contact of the contact portion 113 of the first guide rib 110 with the side surface of one corner of the bracket 67 holds rotation of the bracket 67 when the screw fastening force is transmitted to the bracket 67 to rotate the bracket 67.

In the meantime, though not shown, the contact portion 133 of the second guide rib 130 is used in a structure in which the screw 'S' is fastened in a counter clockwise direction.

In this instance, it is preferable that, after the screw S is fastened to the second fastening hole portion 75 on a side where the second guide rib 130 is mounted, to fix the one end of the bracket 67, a screw is fastened to the first fastening hole portion 73 to fix the other end of the bracket 67.

In this case, the contact portion 133 of the second guide rib 130 prevents the bracket 67 from rotating.

Thus, the temperature sensor 60 is mounted on the upper side of the case 51.

FIG. 6 illustrates an exploded perspective view of another variation of a steam generator in accordance with a first preferred embodiment of the present invention, showing a step in which a temperature sensor is mounted on the steam generator, and FIG. 7 illustrates a diagram showing a step in which another variation of a bracket in accordance with a first preferred embodiment of the present invention is fastened, schematically.

Referring to FIG. 6, the bracket rotation preventive portion 100 in accordance with another preferred embodiment of the present invention includes a first guide rib 110 projected from an upper surface of the case 51 so as to be in surface to surface contact with a side surface in the vicinity of one corner of the bracket 67 for holding rotation of the bracket 67 rotating together with the fastening member in a case the fastening member is being fastened in a clockwise direction, and a second guide rib 130 projected front the upper surface of the case 51 so as to be in surface to surface contact with the other side surface opposite to the side surface in the vicinity of a diagonally opposite corner of the bracket 67 for holding rotation of the bracket 67 rotating together with the fastening member in a case the fastening member is being fastened in the clockwise direction.

Different from the foregoing embodiment, the another variation of the first embodiment of the present invention suggests a first guide rib 110 mounted so as to be in surface to surface contact with a side surface in the vicinity of one corner of the bracket 67, and a second guide rib 130 mounted so as to be in surface to surface contact with the other side surface opposite to the side surface in the vicinity of a diagonally opposite corner of the bracket 67.

In this instance too, the guide ribs 110, and 130 are fabricated as one body with the fastening portion 70, respectively.

Each of the guide ribs 110 and 130 may include a supporting portion 111, or 131 projected from the upper surface of the case 51 for supporting an underside of the bracket 67, and a contact portion 113, or 133 projected upward from one end of the supporting portion 111, or 131 for being in contact with either side surface of the bracket 67.

A process for mounting the temperature sensor on the foregoing another variation of a steam generator in a drum type washing machine in accordance with a first preferred embodiment of the present invention will be described.

At first, the sensor portion 61 is placed in the hole 71 of the fastening portion 70 such that the sensor portion 61 is positioned in the case 51.

Then, an underside of the bracket 67 fixed to the wire 63 is placed on the supporting portions 111, and 131 of the guide ribs 110, and 130.

In this instance, the side surface in the vicinity of one corner of the bracket 67 is in contact with the contact portion 113 of the first guide rib 110, and the other side surface opposite to the side surface in the vicinity of the diagonally opposite corner of the bracket 67 is in contact with the contact portion 133 of the second guide rib 130.

Next, after the screw 'S' is fastened to the first fastening hole portion 73 on a side where the first guide rib 110 is mounted in a clockwise direction, to fix one end of the bracket 67, and the screw 'S' is fastened to the second fastening hole portion 75 on a side where the second guide rib 130 is mounted in the clockwise direction, to fix the other end of the bracket 67.

In the embodiment of the present invention, it makes no difference even if a fastening order of the screws is changed. However, it is more preferable that clockwise screws are used.

Referring to FIG. 7, if the screw fastening is made thus, because the contact portion 113 of the first guide rib 110 is in surface to surface contact with the side surface in the vicinity of one corner of the bracket 67, the contact portion 113 holds rotation of the bracket 67 to prevent the bracket 67 from rotating at the time the screw fastening force is transmitted to the bracket 67 to rotate the bracket 67.

In the meantime, if the fastening order of the screws S is changed, to fasten one end of the bracket 67 on a side of the second fastening hole portion 75 at first, and the other end of the bracket 67 on a side of the first fastening hole portion 73 next, because the contact portion 133 of the first guide rib 130 is in surface to surface contact with the other side surface opposite to the side surface in the vicinity of a diagonally opposite corner of the bracket 67, the contact portion 133 holds rotation of the bracket 67 to prevent the bracket 67 from rotating at the time the screw fastening force is transmitted to the bracket 67 to rotate the bracket 67.

The temperature sensor 60 in accordance with a first preferred embodiment of the present invention includes a sensor portion 61 in the case 51, a connector 63 on an outside of the case 51, and a wire 65 connected between the sensor portion 61 and the connector 63.

In the first preferred embodiment of the present invention, it is preferable that a wire holder 200 is provided for holding the wire 65 and the connector 63, each with a space from the upper portion of the case 51.

For an example, referring to FIGS. 8 and 9, the wire holder 200 may include a holder portion 210 for holding the wire 65 of the temperature sensor, a supporting portion 230 extended from the holder portion 210 for supporting the wire 65 of the temperature sensor in a state the wire 65 is spaced from the upper portion of the case 51, and a fastening portion 250 extended from the supporting portion 230 for fastening the supporting portion 230.

Referring to FIG. 10, the holder portion 210 includes a holder forming portion 213 for surrounding the wire 65, a pass through hole 215 in the holder forming portion 213, and stoppers 217 on the holder forming portion 213 for placing in the pass through hole 215 to prevent the holder forming portion 213 holding the wire 65 from being loosened.

In more detail, the holder forming portion 213 has a length enough to surround the wire 65 if the wire holder 200 is stretched, fully. The pass through hole 215 is formed to hold the stoppers 217 in a state the holder forming portion 213 surrounds the wire 65, to prevent the holder forming portion 213 surrounding the wire 65 from loosening.

In the meantime, the stoppers 217 may be formed on a front surface or a back surface of the holder forming portion 213.

It is preferable that the fastening portion 250 is fastening to the fastening portion 91 of the water level sensor 90.

This is for serving a double purpose of reducing a production cost and an assembly process in fastening the wire holder 200 to the upper portion of the case 51, not by providing a separate fastening portion 91, but by fastening the wire holder 200 to the fastening portion 91 to which the water level sensor 90 is fastened.

The process for mounting the temperature sensor on the case of the steam generator by using the holder in accordance with the first preferred embodiment, and effects thereof will be described.

In surrounding the wire 65 with the holder forming portion 213 of the holder portion 210, after passing fastening portion 250 and the stoppers 217 through the pass through hole 215 at the end of the holder forming portion 213, the stoppers 217 are made to be held at one side of the pass through hole 215.

Then, the wire 65 is surrounded by the holder forming portion 213, and the stoppers 217 held at the pass through hole 215 prevents the holder forming portion 213 surrounding the wire 65 from loosening.

Next, the wire holder 200 at the fastening portion 250 is fastened to the fastening portion 91, which is provided for fastening the water level sensor 90 with the screw S which is a separate fastening member, together with the water level sensor 90.

According to above steps, the wire 65 and the connector 63 of the temperature sensor are fastened to the case 51 in a state the wire 65 and the connector 63 are spaced from the upper portion of the case 51 by using the wire holder 200.

That is, as the wire 65 and the connector 63 of the temperature sensor 60 are fastened to the case 51 in a state the wire 65 and the connector 63 are spaced from the upper portion of the case 51 by using the wire holder 200, the direct transmission of heat from the case 51 to the wire 65 and the connector 63 can be prevented.

FIG. 11 illustrates a perspective view of one variation of a steam generator in accordance with a second preferred embodiment of the present invention, showing a step in which a temperature sensor is mounted on the steam generator, FIG. 12 illustrates a diagram showing a step in which a variation of a temperature sensor in accordance with a second preferred embodiment of the present invention is mounted schematically, and FIG. 13 illustrates a section showing a state in which a variation of a temperature sensor in accordance with a second preferred embodiment of the present invention is mounted.

Referring to FIG. 11, a structure for mounting a temperature sensor on a steam generator in accordance with one variation of second embodiment of the present invention includes a case 51 which is an exterior of a steam generator, a temperature sensor 60 in the case for measuring a temperature of heated water, a bracket 67 on the temperature sensor for fixing the temperature sensor 60 to the case, and a bracket fastening portion for pressing down the bracket 67 at opposite sides thereof for fastening the bracket 67 to an upper surface of the case 51.

The temperature sensor includes a sensor portion 61 passed through a hole with a projected rim in the upper surface of the case 51 and provided in the case, a connector 63 provided to an outside of the case 51, and a wire 65 connected between the sensor portion 61 and the connector 63.

The bracket fastening portion in accordance with one variation of second embodiment of the present invention includes a first supporting block 310 projected upward from an upper portion of the case 51 for supporting one end of the bracket 67, and a second supporting block 330 opposite to the first supporting block 310 for supporting the other end of the bracket 67.

The bracket fastening portion also includes a first fastening slot 350 in one side of the first supporting block 310 for placing in and fastening one end of the bracket 67 thereto, and a second fastening slot 370 in the second supporting block 330 at a portion opposite to the first supporting block 310 for placing in and fastening the other end of the bracket 67 thereto.

It is preferable that the first fastening slot 350 has a width which becomes the smaller as it goes from one end toward the other end the more, and the second fastening slot 370 has a width formed opposite to the first fastening slot 350, for preventing the bracket 67 from free falling off the fastening slots 350, and 370 respectively as the bracket 67 is press fit in the fastening slots 350, and 370 owing to the width W2 of the other end formed smaller than the width W1 of the one end in a case opposite side ends of the bracket 67 are placed in and fastened to first fastening slot 350 and the second fastening slot 370.

In the meantime, referring to FIG. 13, it is preferable that lower surfaces of the first fastening slot 350 and the second fastening slot 370 are parallel to the underside surface of the hole 71, for rigid fastening of the bracket 67, horizontally.

In the meantime, it is more preferable that the fastening slots 350, and 370 have fastening projections 410 respectively, and the bracket has recesses 430 for inserting the fastening projections 410 therein respectively, for inserting the fastening projections 410 on the fastening slots 350, and 370 into the recesses 430 in the bracket 67 in a process the bracket 67 is placed in the fastening slots 350, and 370, to fasten the bracket, more rigidly.

Of course, it is viable that the fastening projections 410 are formed on the bracket 67 and the recesses 430 are formed in the fastening slots 350, and 370, for inserting the fastening projections 410, respectively.

A process of mounting the temperature sensor on the case of the steam generator in accordance with one variation of second embodiment of the present invention, and effects thereof will be described.

At first, the sensor portion 61 of the temperature sensor 60 is placed in the case 51 through the hole 71 in the case 51. In this instance, an underside of the bracket 67 is placed on an upper surface of the hole 71.

Then, referring to FIG. 12, after the bracket 67 is brought into a position perpendicular to the supporting blocks 310 and 330 respectively, the bracket 67 is turned toward the fastening slots 350, and 370 in the supporting blocks 310, and 330 such that one end of the bracket 67 is placed in and held in the first fastening slot 350, and the other end of the bracket 67 is placed in and held in the second fastening slot 370.

Since each of the fastening slots 350, and 370 has the width which becomes the smaller as it goes from one side to the other side the more, the bracket 67 is press fit in the fastening slots 350, and 370, respectively.

Because the fastening projections 410 on the fastening slots 350, and 370 are inserted in the recesses 430 in a process opposite ends of the bracket 67 is placed in the fastening slots 350, and 370, the opposite ends of the bracket 67 are fastened to the fastening slots 350, and 370, more rigidly.

According to above process, the temperature sensor is mounted on the upper portion of the case 51 of the steam generator.

FIG. 14 illustrates a perspective view of another variation of a steam generator in accordance with a second preferred embodiment of the present invention, showing a step in which a temperature sensor is mounted on the steam generator, and FIG. 15 illustrates a perspective view of another variation of a steam generator in accordance with a second preferred embodiment of the present invention, showing a step in which a temperature sensor is mounted on the steam generator.

Referring to FIGS. 14 and 15, a bracket fastening portion in accordance with another variation of a second preferred embodiment of the present invention includes two or more than two hooks 510 provided to an upper surface of the case 51, and hook holding slots 530 in a surface of the bracket 67 for holding the hooks 510, respectively.

Another variation of the second embodiment of the present invention suggests two hooks 510 provided to the upper surface of the case 51.

Each of the hooks 510 includes a base portion 511 projected from the upper portion of the case 51, a supporting portion 513 projected from the base 511 horizontally, and a holder 515 projected upward from the base 511.

The base 511 is placed in the hook holding slot 530 in the bracket 67, to suggest a mounting position of the bracket 67, and the supporting portion 513 supports an underside of the bracket in a state the base 511 is placed in the hook holding slot 530, and the holder 515 prevents the bracket 67 supported on the supporting portion from falling off the supporting portion.

It is preferable that undersides of the supporting portions 513 are parallel to the upper surface of the hole 71.

In mounting the temperature sensor in accordance with another variation of the second preferred embodiment of the present invention, the base 511 of the hook 510 is placed in the hook holding slot 530 in the bracket 67.

In this instance, referring to FIG. 15, the underside of the bracket 67 is seated on the supporting portion 513, and an upper side of the bracket 67 is held by the holder 515, to hold the bracket 67 with the hooks 510.

The holder 515 prevents the hook holding slot 530 in the bracket 67 from falling off the base 511.

Though not shown, also in the second embodiment of the present invention, it is preferable that a wire holder 200 is provided for mounting the wire 61 and the connector 65 with spaces from the case 51, the same as ones described in the first preferred embodiment of the present invention.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

INDUSTRIAL APPLICABILITY

The first preferred embodiment of the present invention prevents the bracket from rotating by fastening force of the fastening member in mounting the temperature sensor, to permit more effective and easy assembly, which provides significantly high industrial applicability.

The second preferred embodiment of the present invention improves processability, and reduces an assembly time period and unit cost, to provide significantly high industrial applicability because the bracket fastening portion is provided for mounting the temperature sensor, permitting to dispense with separate fastening members of screws.

The fixing of the wire and the connector with spaces from the case by using the wire holder prevents the wire and the connector from deforming or suffering from damage, thereby providing high industrial applicability.

The invention claimed is:

1. A steam generator for a drum type washing machine comprising:

a case which is an exterior of the steam generator;

a temperature sensor provided on the case for sensing a temperature;

a bracket for fixing the temperature sensor;

a fastening portion provided on the case for fastening the bracket to the case with separate fastening members, wherein the fastening members are screws; and a bracket rotation preventive portion provided on the case for preventing the bracket from rotating at the time the temperature sensor is mounted.

2. The steam generator as claimed in claim 1, wherein the bracket rotation preventive portion is at least one guide rib projected from an upper surface of the case.

3. The steam generator as claimed in claim 1, wherein the bracket rotation preventive portion includes;

a first guide rib projected from an upper surface of the case so as to be in surface to surface contact with a side surface in the vicinity of one corner of the bracket for preventing the bracket from rotating together with the fastening member in a case the fastening member is being fastened in a clockwise direction, and a second guide rib projected from the upper surface of the case so as to be in surface to surface contact with the side surface in the vicinity of the other corner of the bracket for preventing the bracket from rotating together with the fastening member in a case the fastening member is being fastened in a counter clockwise direction.

4. The steam generator as claimed in claim 3, wherein each of the guide ribs includes;

a supporting portion projected upward from the upper surface of the case for supporting an underside of the bracket, and a contact portion projected upward from one end of the supporting portion for being in contact with the side surface of the bracket.

5. The steam generator as claimed in claim 1, wherein the bracket rotation preventive portion includes;

a first guide rib projected from an upper surface of the case so as to be in surface to surface contact with a side surface in the vicinity of one corner of the bracket for preventing the bracket from rotating together with the fastening member in a case the fastening member is being fastened in a clockwise direction, and a second guide rib projected from the upper surface of the case so as to be in surface to surface contact with the other side surface opposite to the side surface in the vicinity of a diagonally opposite corner of the bracket for preventing the bracket from rotating with the fastening member in a case the fastening member is being fastened in the clockwise direction.

6. The steam generator as claimed in claim 5, wherein each of the guide ribs includes;

a supporting portion projected upward from the upper surface of the case for supporting an underside of the bracket, and a contact portion projected upward from one end of the supporting portion for being in contact with the side surface of the bracket.

7. The steam generator as claimed in claim 1, wherein the bracket rotation preventive portion is formed as one body with the fastening portion.

8. The steam generator as claimed in claim 1, wherein the temperature sensor includes;

a sensor portion, a connector on an outside of the case connected for supplying power to the sensor portion, and a wire connected between the sensor portion and the connector.

9. The steam generator as claimed in claim 8, further comprising a wire holder having one end provided on the case and the other end provided on the wire.

10. The steam generator as claimed in claim 9, wherein the wire holder includes;

a holder portion provided on the wire of the temperature sensor, a supporting portion extended from the holder portion for supporting the wire in a state where the wire is spaced from the upper portion of the case, and a fastening portion extended from the supporting portion for fastening the supporting portion.

11. The steam generator as claimed in claim 10, wherein the holder portion includes;

a holder forming portion for surrounding the wire, a pass through hole in the holder forming portion, and stoppers on the holder forming portion for placing in the pass through hole to prevent the holder forming portion holding the wire from being loosened.

12. The steam generator as claimed in claim 11, wherein the stoppers are provided on a front surface or a back surface of the holder forming portion.

13. The steam generator as claimed in claim 10, further comprising a water level sensor to sense water level in the steam generator, wherein the fastening portion is fastened with a separate fastening member configured to fasten the water level sensor the steam generator.

14. A steam generator for a drum type washing machine comprising:

a case which is an exterior of the steam generator;

a temperature sensor provided on the case for sensing a temperature, the temperature sensor including a sensor portion in the case, a connector on an outside of the case connected for supplying power to the sensor portion, and a wire connected between the sensor portion and the connector;

a bracket for fixing the temperature sensor to the case;

a bracket fastening portion for fastening the bracket to the case;

a wire holder for supporting the wire in a state where the wire is spaced from the upper portion of the case, wherein the wire holder includes a holder portion provided on the wire of the temperature sensor, a supporting portion extended from the holder portion for supporting the wire in a state where the wire is spaced from the upper portion of the case and a fastening portion extended from the supporting portion for fastening the supporting portion; and a separate fastening member configured to fasten the fastening portion to the case.

15. The steam generator as claimed in claim 14, wherein the bracket fastening portion includes;

a first supporting block provided on an upper portion of the case for supporting one end of the bracket, and a second supporting block provided on the upper portion of the case for supporting the other end of the bracket.

16. The steam generator as claimed in claim 15, wherein the bracket fastening portion includes;

a first fastening slot in one side of the first supporting block for placing in and fastening one end of the bracket thereto, and a second fastening slot in the second supporting block at a portion opposite to the first supporting block for placing in and fastening the other end of the bracket thereto.

17. The steam generator as claimed in claim 16, wherein the second fastening slot is formed opposite to the first fastening slot.

18. The steam generator as claimed in claim 16, wherein each of the fastening slots has a fastening projection and the bracket has recesses for inserting the fastening projections.

19. The steam generator as claimed in claim 16, wherein the bracket has fastening projections formed thereon and each of the fastening slots has a recess for inserting the fastening projections therein.

20. The steam generator as claimed in claim 14, wherein the bracket fastening portion includes;

at least two hooks provided on an upper surface of the case, and hook holding slots in a surface of the bracket for holding the hooks, respectively.

21. The steam generator as claimed in claim 20, wherein each of the hooks includes;

a base portion projected from the upper portion of the case, a supporting portion projected from the base horizontally for supporting an underside of the bracket in a state where the base is inserted in the hook holding slot, and a holder projected upward from the base for preventing the bracket supported on the supporting portion from falling off the supporting portion.

22. The steam generator as claimed in claim 14, wherein the holder portion includes;

a holder forming portion for surrounding the wire, a pass through hole in the holder forming portion, and stoppers on the holder forming portion for placing in the pass through hole to prevent the holder forming portion holding the wire from being loosened.

23. The steam generator as claimed in claim 22, wherein the stoppers are provided on a front surface or a back surface of the holder forming portion.

24. The steam generator as claimed in claim 14, further comprising a water level sensor to sense water level in the steam generator, wherein the water level sensor is fastened with the separate fastening member to the case.

* * * * *